US006773182B2

(12) United States Patent
Yang

(10) Patent No.: US 6,773,182 B2
(45) Date of Patent: Aug. 10, 2004

(54) PAPER CASSETTE IN PRINTER

(75) Inventor: Chun-seung Yang, Suwon (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 10/281,119

(22) Filed: Oct. 28, 2002

(65) Prior Publication Data

US 2003/0091378 A1 May 15, 2003

(30) Foreign Application Priority Data

Nov. 12, 2001 (KR) ..... 2001-70014

(51) Int. Cl.[7] ..... B41J 13/10
(52) U.S. Cl. ..... 400/624; 400/625; 271/160
(58) Field of Search ..... 271/160; 400/624, 400/625, 627, 628

(56) References Cited

U.S. PATENT DOCUMENTS 4,319,741 A * 3/1982 Okamoto ..... 271/118
5,163,670 A * 11/1992 Sellers et al. ..... 271/157
5,364,195 A * 11/1994 Kanemitsu et al. ..... 347/4
5,815,787 A * 9/1998 Crayton et al. ..... 399/393
5,954,327 A * 9/1999 Lin et al. ..... 271/110
6,039,315 A * 3/2000 Lim ..... 271/160
6,129,348 A * 10/2000 Park ..... 271/160
6,145,828 A * 11/2000 Arai ..... 271/3.03
6,182,963 B1 * 2/2001 Yergenson ..... 271/160
6,357,740 B1 * 3/2002 Inoue et al. ..... 271/160

* cited by examiner

*Primary Examiner*—Andrew H. Hirshfeld
*Assistant Examiner*—Dave A. Ghatt
(74) *Attorney, Agent, or Firm*—Staas & Halsey LLP

(57) ABSTRACT

A paper cassette adapted for use in a printing device has a cassette body connected to a body of the printing device, a supporting plate having a first end being pivotally disposed in the cassette body to support printing paper, a spring elastically supporting a lower side of the supporting plate relative to a bottom of the cassette body, a finger member disposed on the cassette body to limit a rising height of the supporting plate and separating the printing paper sheet by sheet, and a shock absorbing portion guiding a rising and lowering movement of the supporting plate and lessening a shock exerted on the finger member when the supporting plate stacked with the printing paper rises from a lowered state by reducing a rising speed of the supporting plate that is raised by the spring.

51 Claims, 8 Drawing Sheets

PAPER CASSETTE IN PRINTER

CROSS-REFERENCE TO RELATED APPLICATIONS

This application claims the benefit of Korean Application No. 2001-70014, filed Nov. 12, 2001, in the Korean Intellectual Property Office, the disclosure of which is incorporated herein by reference.

BACKGROUND OF THE INVENTION

1. Field of the Invention

The present invention relates to a paper cassette holding printing paper and mounted in a printer body of a printer, and more particularly, to a paper cassette having a shock absorbing unit absorbing a shock generated from a supporting plate of the paper cassette which moves at a high speed or at a low speed.

2. Description of the Related Art

Generally, a printing device like a copier and a laser printer has a paper cassette holding printing paper and mounted in a body of the printing device.

FIG. 1 is a sectional view schematically showing a typical example of the paper cassette. Referring to FIG. 1, the paper cassette includes a cassette body 10, a paper supporting plate 11 movably disposed within the cassette body 10 to be raised, lowered, and pivoted, a spring 12 elastically supporting the supporting plate 11, a finger member 13 limiting a range of a rising movement of the supporting plate 11 and also separating the printing paper from a stack of the paper cassette sheet by sheet, and a locking unit 14 securing the supporting plate 11 to a bottom of the cassette body 10.

One end of the supporting plate 11 is connected to the cassette body 10 by a hinge 15 and accordingly hinged on the hinge 15.

In order to stack the printing paper in the cassette body 10 of the paper cassette constructed as above, a user of the printing device pushes the supporting plate 11 downward to the bottom of the cassette body 10. Accordingly, the supporting plate 11 is pushed to be in tight contact with the bottom of the cassette body 10 and maintained in a horizontal state as indicated by two-dotted lines of FIG. 1 by the locking unit 14. In the horizontal state of the supporting plate 11, the user stacks the printing paper on the supporting plate 11 and then reconnects the paper cassette to the body of the printing device by sliding the paper cassette into the body of the printing device. As the cassette body 11 is re-connected to the body of the printing device, the locking unit 14 is interfered with by inner walls of the body of the printing device to be unlocked.

Being unlocked, the supporting plate 11 springs up by elasticity (an elastic force) of the spring 12. A speed with which the supporting plate 11 springs up is inversely-proportional to an amount of the printing paper stacked on the supporting plate 11 of the paper cassette. In other words, when there is a large amount of the printing paper stacked on the supporting plate 11, the speed of a jumping movement of the supporting plate 11 is relatively reduced by a weight of the printing paper.

When there is a small amount of the printing paper on the supporting plate 11, the supporting plate 11 springs up quickly and collides against the finger member 13 with an intense shock. Here, due to the intense shock, some sheets of the printing paper may be slid (released) from the finger member 13, and sometimes there is a considerably high noise occurring from the supporting plate 11 and the finger member 13.

In an attempt to solve the above-described problem, a suggestion has been made that the locking unit 14 should be removed from the paper cassette. In this case, the user has to stack the printing paper in a state that the supporting plate 10 is at a highest point where the supporting plate 10 has sprung up by the elasticity of the spring 12. Otherwise, the user has to stack the printing paper with one hand while pushing down the supporting plate 10 with the other hand. This is very inconvenient for the user to stack the printing paper in the paper cassette, and this situation becomes even worse when the user has to align sides of the paper with sidewalls of the paper cassette.

SUMMARY OF THE INVENTION

The present invention has been made to overcome the above and other problems of the related art, and accordingly, it is an object of the present invention to provide a paper cassette adapted for use in a printing device and having an improved structure for a user to easily stack printing paper without noise.

Additional objects and advantages of the invention will be set forth in part in the description which follows and, in part, will be obvious from the description, or may be learned by practice of the invention.

The above and other objects are achieved by providing a paper cassette for use in a printing device according to an embodiment of the present invention. The paper cassette includes a cassette body connected to a body of the printing device, a supporting plate having a first end pivotally disposed in the cassette body to support printing paper, a spring elastically supporting a lower side of the supporting plate relative to a bottom of the cassette body, a finger member disposed on the cassette body to limit a rising height of the supporting plate and separating the printing paper sheet by sheet, and a shock absorbing unit guiding a rising and lowering movement of the supporting plate and lessening (absorbing) a shock exerted on the finger member by reducing a rising speed of the supporting plate when the supporting plate stacked with the printing paper is raised from a lowered state by the spring.

The shock absorbing unit includes a guide pin formed on a second end of the supporting plate and a pivot member pivotally disposed on the cassette body. The pivot member includes a first guide rail that simply guides the guide pin, and a second guide rail that guides the guide pin while providing the guide pin with a frictional force so as to reduce a pivotal force of the supporting plate.

The pivot member reciprocates between a first position and a second position so that the first guide rail guides the guide pin when the pivot member is in the first position and the second guide rail guides the guide pin when the pivot member is in the second position. It is possible that the pivot member is moved to the first position when the supporting plate is at the lowered state.

During raising the supporting plate, the guide pin comes into contact with a first interference portion provided at a first entry portion of the first guide rail, and the pivot member is either maintained at the first position or forced to pivot to the second position according to the extent (an amount) of a contact force generated between the guide pin and the first interference portion.

The extent of the contact force is determined according to a rising speed of the supporting plate that is determined according to an amount of the printing paper stacked on the supporting plate. The guide pin is guided from the first entry portion of the first guide rail to a second entry portion of the second guide rail by a guide side connected between the first entry portion of the first guide rail and the second entry portion of the second guide rail.

According to an aspect of the present invention, at least a pair of elastic substances are disposed on an inner side of the second guide rail to provide the frictional force during the movement of the guide pin.

The pair of elastic substances is formed away from the second entry portion of the second guide rail by a distance corresponding to two-thirds of a length of the second guide rail.

A second interference portion protrudes from the second entry portion of the second guide rail to have a predetermined shape to interfere with the guide pin moving into and out of the second guide rail. With the supporting plate being lowered and the guide pin moving out from the second guide rail, the pivot member is forcedly pivoted from the second position to the first position by the contact force at the second interference portion.

According to another aspect of the present invention, a guide unit limits a range of pivotal movement of the pivot member and guiding the pivotal movement of the pivot member. The guide unit includes a third guide rail formed in the pivot member and a securing pin disposed in the cassette body to move along the third guide rail.

According to yet another aspect of the present invention, a locking unit securely locks the supporting plate in a lowered position when the supporting plate is lowered to be in close contact with a bottom of the cassette body, wherein the locking unit is unlocked when the supporting plate is inserted into the body of the printing device.

The above and other objects are also accomplished by providing a paper cassette adapted for use in a printing device according to another embodiment of the present invention. The paper cassette includes a cassette body connected to a body of the printing device a supporting plate movably disposed within the cassette body to be raised and lowered during supporting printing paper, a spring elastically supporting a lower end of the supporting plate relative to a bottom of the cassette body, and a shock absorbing unit guiding a rising and lowering movement of the supporting plate to lessen or absorb a shock by reducing a rising speed of the supporting plate when the supporting plate stacked with the printing paper is raised by the spring, wherein the shock absorbing unit limits a rising height of the supporting plate.

The shock absorbing unit includes a portion defining an opening formed at a first end of the supporting plate, a hinge pin formed on the cassette body to be inserted into the opening and to support the first end of the supporting plate to pivot relative to the cassette body and to horizontally slide by a predetermined distance, a guide pin formed at a second end of the supporting plate, and a guide rail in a shape of an arc and formed in the cassette body to guide the guide pin during the rising and lowering movement of the supporting plate. The guide pin is guided to be in contact with one side of the guide rail by a pressing force of the spring, thereby reducing a rising force of the supporting plate. The opening of the portion may be formed at the cassette body while the hinge pin may be formed in the first end of the supporting plate.

According to still another aspect of the present invention, a frictional force providing unit is formed on one side of the guide rail which is contacted with the guide pin, to selectively provide a frictional force according to a moving position of the guide pin.

The frictional force providing unit includes a curved portion curved-in from the one side of the guide rail to provide the guide pin with the frictional force.

The guide rail is a guide slot integrally formed in an inner side of the cassette body.

According to still yet another aspect of the present invention, a secondary slot is formed in the cassette body in parallel with the guide slot to provide the frictional force by being deformed when the guide pin contacts the one side of the guide slot.

BRIEF DESCRIPTION OF THE DRAWINGS

These and other objects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
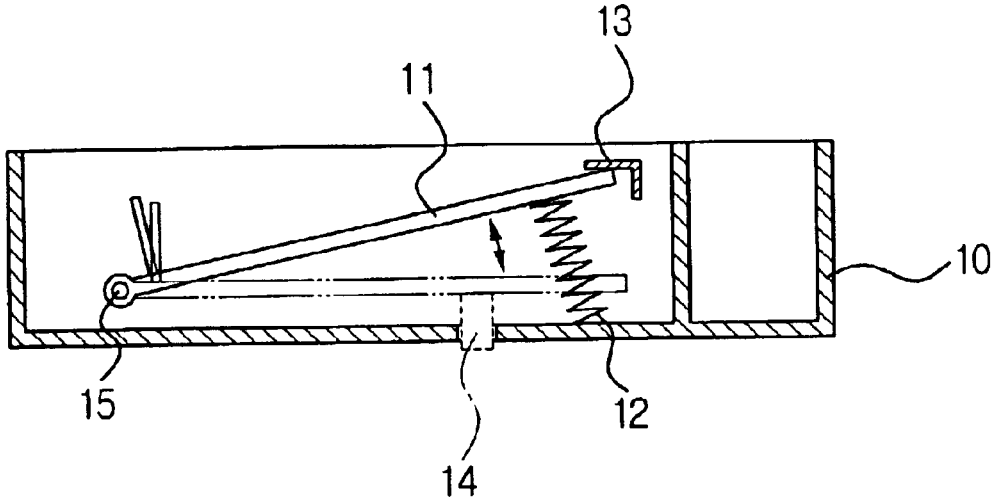
FIG. 1 is a sectional view showing a paper cassette of a conventional printing device.

Reference will now be made in detail to the present preferred embodiments of the present invention, examples of which are illustrated in the accompanying drawings, wherein like reference numerals refer to the like elements throughout. The embodiments are described below in order to explain the present invention by referring to the figures.

From now on, the present invention will be described in greater detail by referring to the appended drawings.

Figure 2:
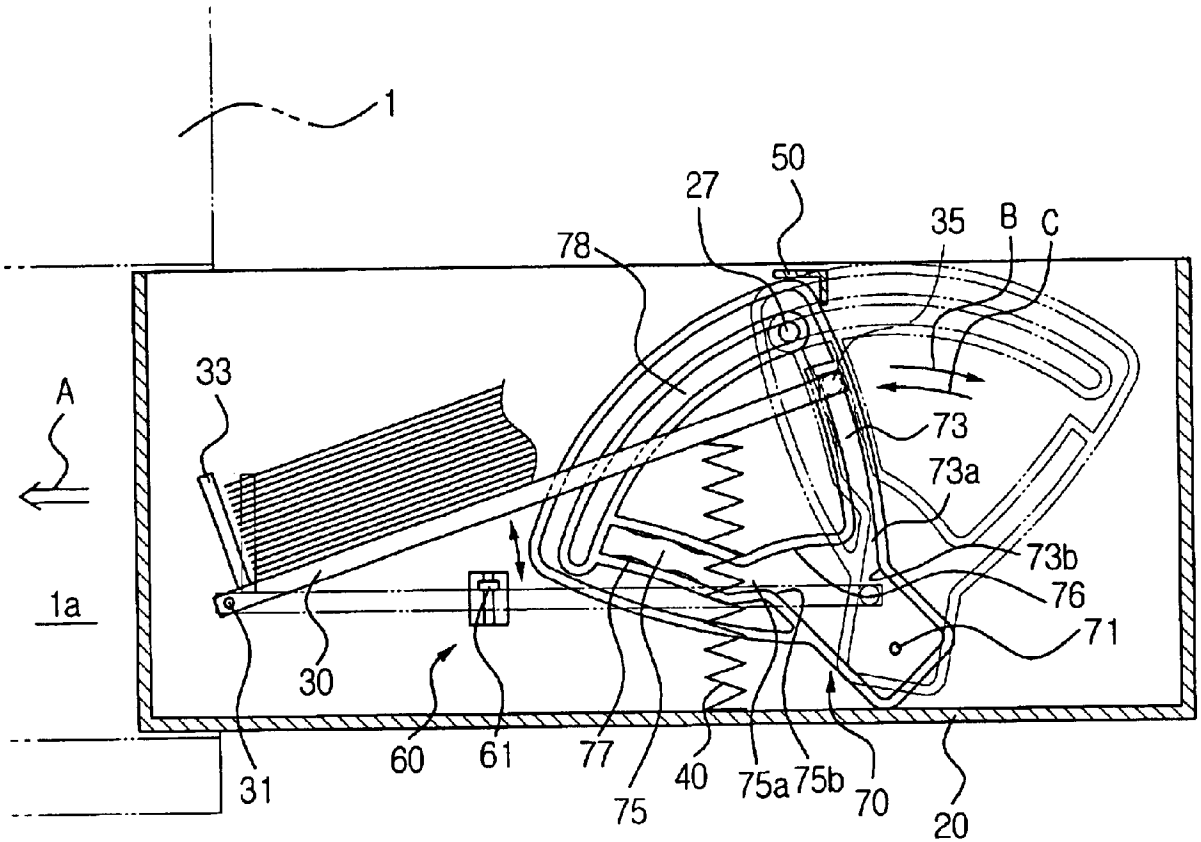
FIG. 2 is a sectional view showing a paper cassette of a printing device according to an embodiment of the present invention.

Referring to FIG. 2, a paper cassette of a printing device according to an embodiment of the present invention includes a cassette body 20, a supporting plate 30 movably disposed within the cassette body 20 to be raised and lowered and pivoted, a spring 40 elastically supporting a lower end of the supporting plate 30 relative to a bottom of the cassette body 20, a finger member 50 preventing a separation of printing paper from the supporting plate 30 and also separating the printing paper from a stack sheet by sheet in an orderly manner, and a shock absorbing unit lessening and absorbing a shock generated by the supporting plate 30 when the supporting plate 20 springs up from a lower position toward the finger member 50.

The cassette body 20 receives the printing paper and is mounted in a mounting portion 1*a* of the printing device 1 in a removable manner.

A first end of the supporting plate 30 is hinged to a lower side of the cassette body 20 with respect to a hinge 31. On an upper side of the supporting plate 30, the printing paper is stacked. An aligning guide 33 may be disposed on the upper side of the supporting plate 30 to align the printing paper in a stack. A second end of the supporting plate 30 is elastically supported by the spring 40. Accordingly, a compression dislocation force of the spring 40 depends on a volume of the printing paper stacked on the supporting plate 30. By a pressing force of the spring 40, the printing paper stacked on the supporting plate 30 is in close contact with the finger member 50 and thus aligned.

The finger member 50 prevents an unwanted separation of the printing paper from the stack and also aligns the printing paper sheets. The finger member 50 also allows the printing paper to be separated sheet by sheet in the orderly manner when the printing paper is picked up from the stack by a pickup roller (not shown).

In order to stack the printing paper on the supporting plate 30, a user first pushes the supporting plate 30 to a state indicated by two-dotted lines of FIG. 2. While the supporting plate 30 is securely disposed at the lowered state, the user stacks the printing paper on the supporting plate 30. A locking unit 60 is provided to lock the supporting plate 30 at the lowered state.

Figure 3:
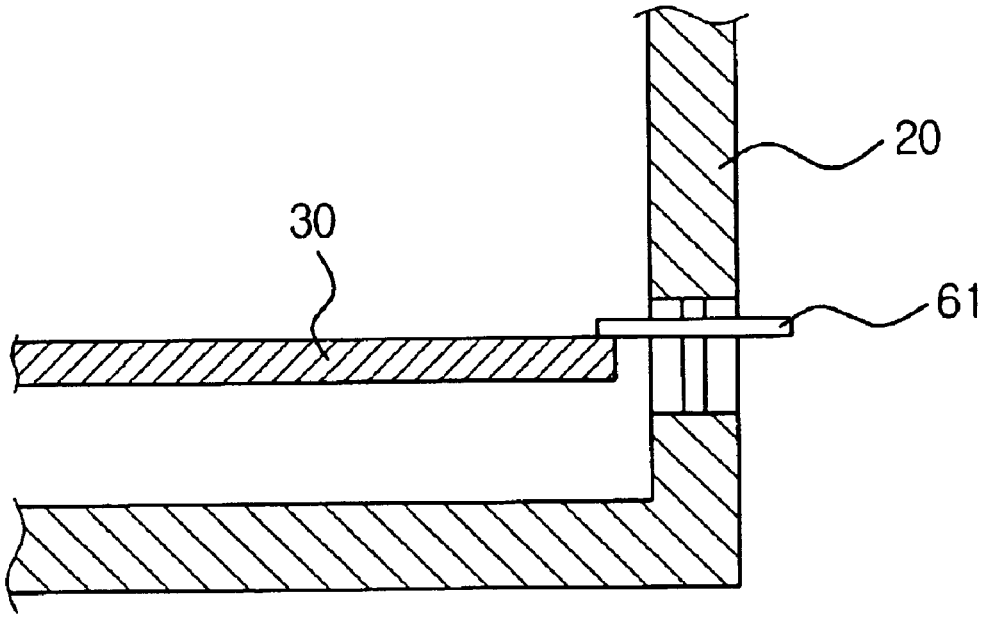
FIG. 3 is a partial sectional view showing a main portion of the paper cassette of FIG. 2.

For the locking unit 60, any generally-known locking means can be employed. For example, as shown in FIGS. 2 and 3, an interference lever 61 may be rotatably disposed on a sidewall of the cassette body 20 to selectively interfere with the upper surface of the supporting plate 30 according to its rotational movement. Accordingly, when the interference lever 61 is rotated up toward the upper surface of the supporting plate 30 that is disposed at the lowered state, a rising movement of the supporting plate 30 is limited. In such a situation, as the user slides the cassette body 20 into the mount portion 1*a* in a direction A, a protrusion (not shown) formed at a predetermined location of the mounting portion 1*a* interferes with the interference lever 61 to rotate the interference lever 61. As a result, the interference lever 61 is released from the upper surface of the supporting plate 30, and instantly, the supporting plate 30 springs up by elasticity (elastic force) of the spring 40.

The shock absorbing unit lessens and absorbs the shock exerted on the corresponding components such as the finger member 50 when the supporting plate 30 springs up abruptly. The shock absorbing unit includes a guide pin 35 formed on the second end of the supporting plate 30 and a pivot member 70 movably disposed in the cassette body 20 at a predetermined angle with respect to the supporting plate 30.

The pivot member 70 pivots on a pivot 71 between a first position (indicated by solid lines of FIG. 2) and a second position (indicated by the two-dotted lines of FIG. 2). One end of the pivot member 70 weighs more than the other end of the pivot member 70 so that the pivot member 70 can move to the first position by its own weight.

The pivot member 70 includes a first guide rail (slot) 73 that guides the guide pin 35 at the first position, and a second guide rail (slot) 75 that guides the guide pin 35 at the second position. The guide rails 73 and 75 have a predetermined length corresponding to a range of the rising/lowering movement of the supporting plate 30. The guide rails 73 and 75 also have a shape of an arc. The first guide rail 73 simply guides the guide pin 35 when the supporting plate 30 is raised at a low speed.

When the supporting plate 30 is abruptly raised at a high speed, the second guide rail 75 guides a movement of the guide pin 35 and also reduces a rising speed of the supporting plate 30. For this, more than two elastic substances 77 are formed on inner sides of the second guide rail 75. The elastic substances 77 are spaced-apart from a second entry portion 75*a* of the second guide rail 75 by two-thirds of a length of the second guide rail 75. The elastic substances 77 provide a frictional force at a location where a moving speed of the guide pin 35 increases and thus lessen and absorb the shock exerted on the finger member 50 and the supporting plate 30 effectively. It is possible that the elastic substances 77 are opposing plate springs that are formed (disposed) on the inner sides of the second guide rail 75. In this embodiment, a pair of elastic substances 77 are spaced-apart from each other by a predetermined distance to gradually decrease the moving speed of the guide pin 35 when the guide pin 35 moves between the pair of the substances 77. Only one elastic substance may be disposed on one of the inner sides of the second guide rail 75.

Meanwhile, a first interference portion 73*b* protrudes from a first entry portion 73*a* of the first guide rail 73. The first interference portion 73*b* may interfere with the moving guide pin 35 when the pivot member 70 is in the first position. As the guide pin 35 is raised, it interferes with the first interference portion 73*b* to transmit a shock to the first interference portion 73*b*. Here, the degree of the transmitted shock is proportional to the moving speed of the guide pin 35. Accordingly, when there is a small amount of the printing paper staked on the supporting plate 30, the supporting plate 30 is raised abruptly by the elasticity of the spring 40. At this time, the guide pin 35 is moved at a high speed and contacts the first interference portion 73*b* with a great force. By the shock, the pivot member 70 is pivoted in a direction B to the second position. As a result, the guide pin 35 is guided by the second guide rail 75. In other words, the pivot member 70 stays at the first position or moves to the second position depending on the degree of a contact force between the guide pin 35 and the first interference portion 73*b* which are in contact with each other as the guide pin 35 rises. The degree of the contact force depends on the rising speed of the supporting plate 30, which depends on the amount of the printing paper staked on the supporting plate 30.

The first and second entry portions 73*a* and 73*a* of the first and the second guide rails 73 and 75 are connected by a guide surface 76 with a predetermined curvature. The guide surface 76 guides the guide pin 35 to be moved between the first entry portion 73*a* of the first guide rail 73 and the second entry portion 73*a* of the second guide rail 75.

The second interference portion 75*b* protrudes from the second entry portion 73*a* of the second guide rail 75 relative to a surface of the second entry portion 73*a* of the second guide rail 75. When the guide pin 35 is lowered along the second guide rail, the second interference portion 75*b* interferes with the guide pin 35. As the lowered guide pin 35 contacts and thus presses the second interference portion 75*b*, the pivot member 70 is pivoted by a shock, which is generated between the guide pin 35 and the second interference portion 75*b*, in a direction C to the first position.

It is also possible that another guide unit is provided to guide the pivotal movement of the pivot member 70 and also to limit a pivot angle of the pivot member 70.

The guide unit includes a third guide rail 78 formed on the pivot member 70 and a securing pin 27 formed on the cassette body 20 to relatively guide the pivot member 70 with respect to the cassette body 20. The third guide rail 78 is formed at a predetermined curvature from a first upper end of the first guide rail 73 to a second upper end of the second guide rail 75. Accordingly, if the securing pin 27 is positioned on one (or the other) end of the third guide rail 78, the pivot member 70 is positioned at the first (or second) position.

An operation of the paper cassette of the printing device constructed as above according to the embodiment of the present invention will be described below.

Figure 4:
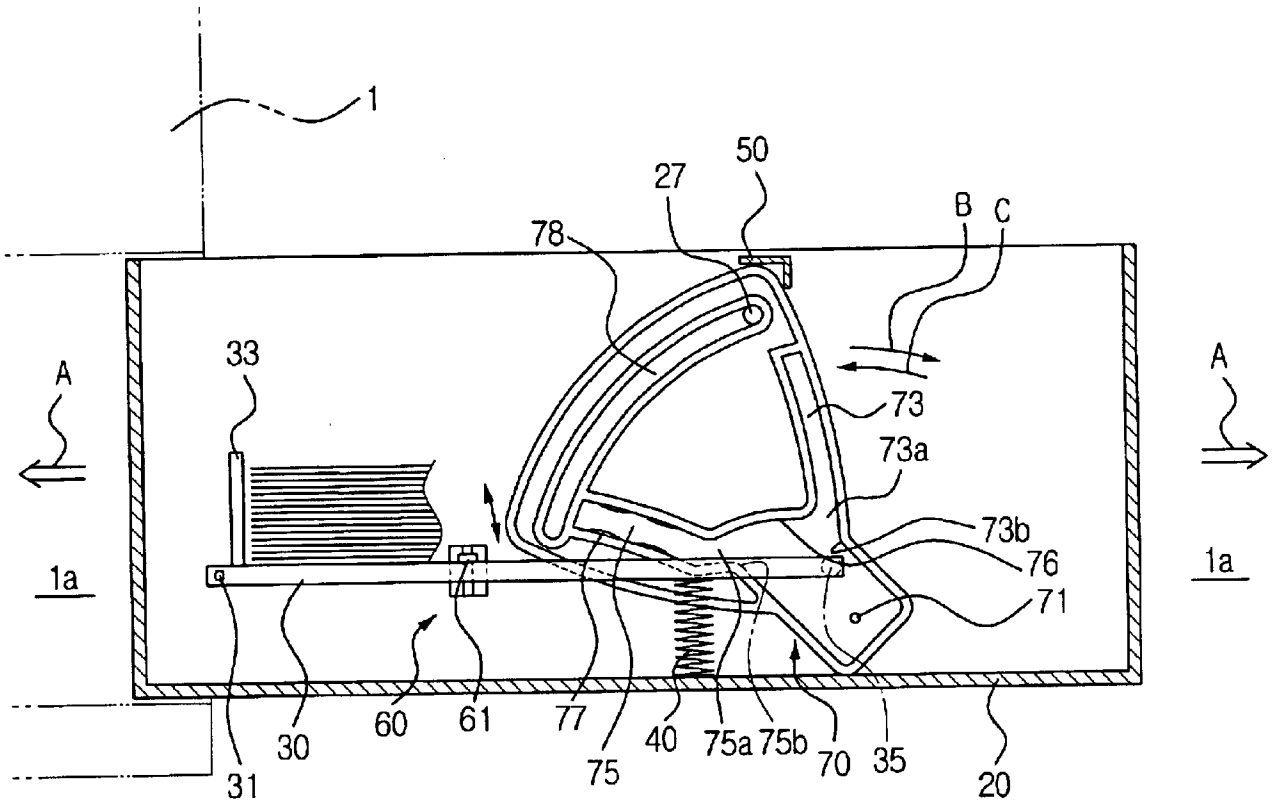
FIGS. 4 through 7 are partial sectional views explaining operations of the paper cassette of FIG. 2.

First, as shown in FIG. 4, in order to stack the printing paper in the paper cassette, the user of the printing device lowers the supporting plate 30 to a horizontal (the lowered) state close to the bottom of the cassette body 20. The supporting plate 30 is locked by the locking unit 60, thereby being maintained at a position of the lowered state even with a recovery force of the spring 40. In such a situation, the user stacks an appropriate amount of the printing paper, e.g., approximately 100–150 sheets of the printing paper on the supporting plate 30. Here, considering that a general paper cassette could hold approximately 300 sheets at a time, a volume of 100–150 sheets is considered to be relatively smaller than a usually recommended volume.

Figure 5:
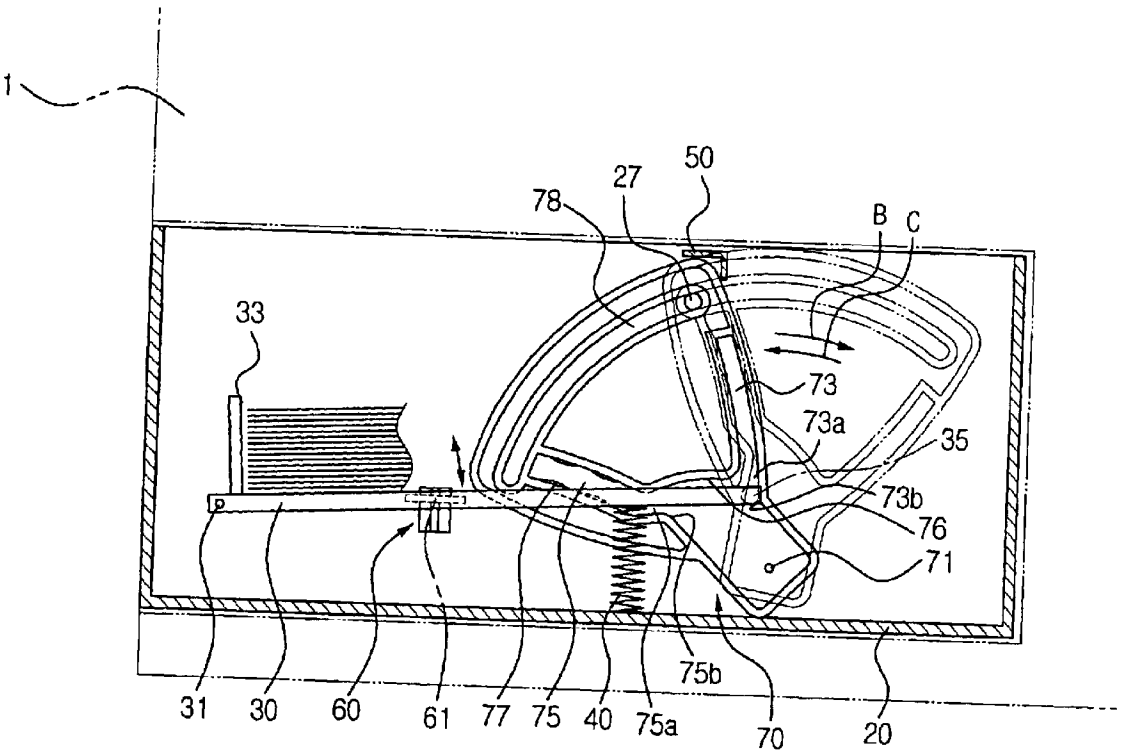
Figure 6:
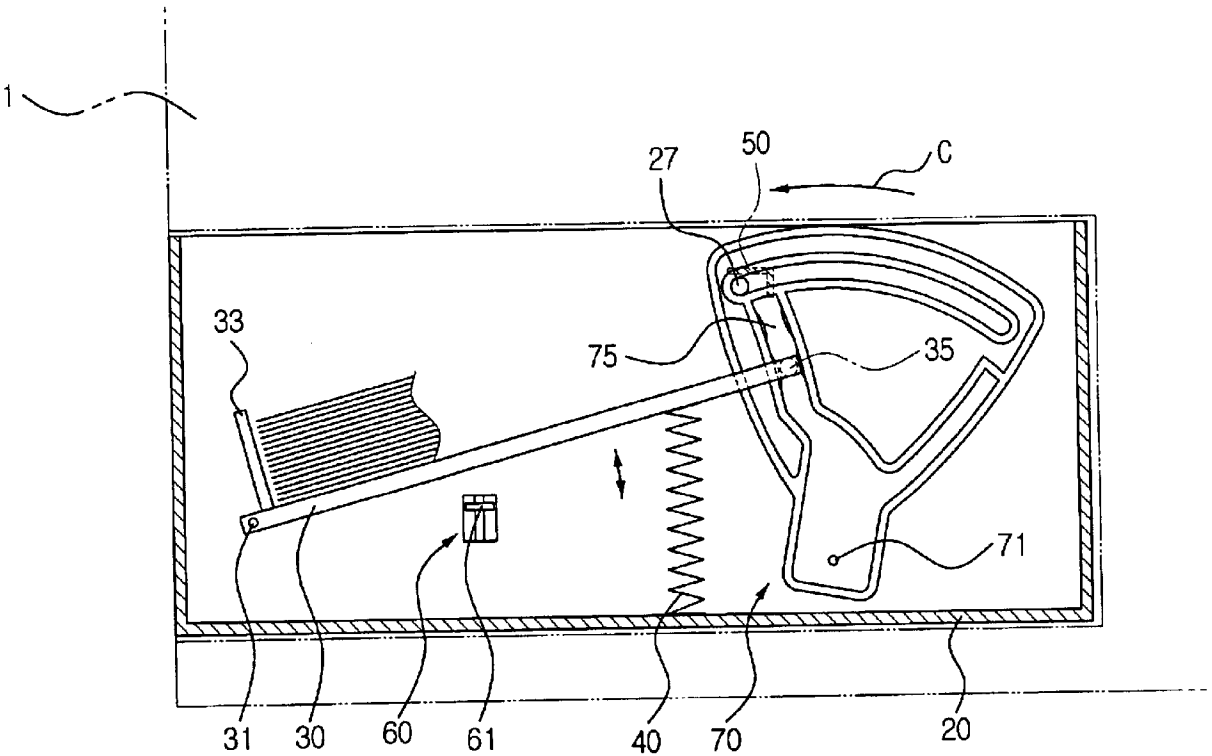

Next, the user slides the cassette body 20 to the mounting portion 1*a* of the printing device body 1 in the direction A. Accordingly, the locking unit 60 is unlocked, and as shown in FIGS. 5 and 6, the supporting plate 30 springs up by the elastic recovery force of the spring 40. Here, since the stack of paper is less than a usually recommended volume, the supporting plate 30 rises with the rising speed relatively faster than a usual speed. Accordingly, the supporting plate 30 springs faster, and the guide pin 35 contacts the first interference portion 73*b* more strongly. At this time, the pivot member 70 pivots in the direction B indicated by an arrow to the second position (indicated by the two-dotted lines).

The guide pin 35 is guided along the guide surface 76 to the second entry portion of the second guide rail 75. The guide pin 35 moves into the second guide rail 75 and thus, the supporting plate 30 keeps rising along the second guide rail 75.

Referring to FIG. 6, the guide pin 35 moving along the second guide rail 75 is subjected to the frictional force as the guide pin 35 contacts the elastic substances 77 disposed through two-thirds of a length of the second guide rail 75 and extended from one end of the second entry portion 73*a* having one-third of the length of the second guide rail 75. Accordingly, the rising speed of the supporting plate 30 is reduced, and the shock is lessened and absorbed. Here, the supporting plate 30 moves in a first speed when the guide pin 35 moves along the second entry portion 75*a*, while the supporting plate 30 moves in a second speed less than the first speed when the guide pin 35 moves along the elastic substances 77 of the second interfere portion 75*b*. Before the supporting plate 30 reaches a maximum rising height, i.e., before the supporting plate 30 collides with the finger member 50, the guide pin 35 contacts the elastic substances 77, and accordingly, the noise occurring as a result of the shock is reduced. Thus, the usual problems occurring in the conventional printing device, i.e., the accidental separation of the printing paper and the occurrence of noise by the shock, can be reduced.

When there are less than 100–150 sheets of printing paper on the supporting plate 30, the rising speed of the supporting plate 30 is faster and the rising height is higher. In this case, the guide pin 35 moves along the second guide rail 75, loses its moving speed first by a first elastic substance 77, and further loses its moving speed a second time by a second elastic substance 77 as the guide pin 35 moves close to an end of the second guide rail 75. Thus, the shock is lessened effectively.

Figure 7:
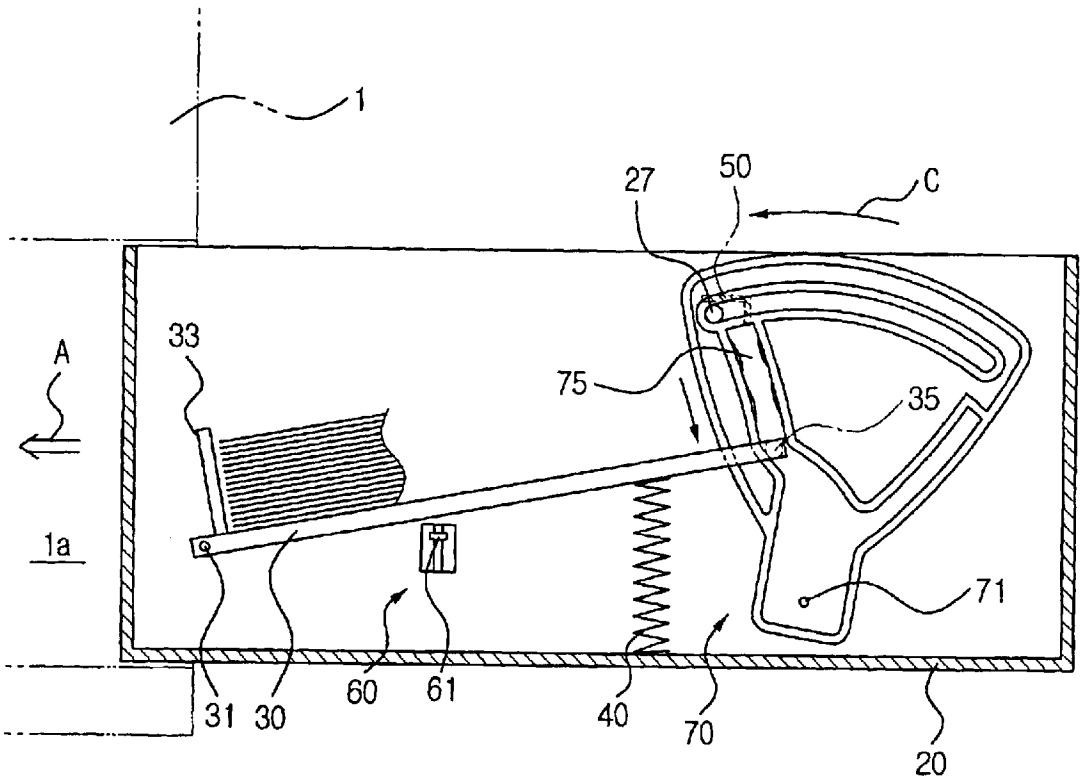

As the printing paper is fed and the volume of the printing paper stacked in the paper cassette decreases in a state of FIG. 6, the supporting plate 30 gradually rises to finally contact the finger member 50. In order to supplement the printing paper, the user withdraws the cassette body 20 from the printing device 1 and then pushes down the supporting plate 30. Then, as shown in FIG. 7, the guide pin 35 slides along the second guide rail 75 and then contacts the second interference portion 75*b*. As a counteraction, the pivot member 70 pivots in the direction C to the first position (i.e., the pivot member 70 returned to a state shown in FIG. 4). Accordingly, the supporting plate 30 is lowered to the horizontal state and maintained at the state by the locking unit 60. Then the user stacks the printing paper on the supporting plate 30.

Next, a case when the user stacks a maximum volume, i.e., 300 sheets of the printing paper on the supporting plate 30 will be described.

First, it is supposed that the printing paper more than the volume of the printing paper as shown in FIG. 4, i.e., approximately 300 sheets of the printing paper, are stacked on the supporting plate 30. When the locking unit 60 is unlocked, the supporting plate 30 is raised by the elastic recovery force of the spring 40. Here, due to a weight of the stacked printing paper, the supporting plate 30 is raised at a slow pace (the low speed). And then, as shown in FIG. 5, the guide pin 35 is in contact with the first interference portion 73*b*. Since the guide pin 35 is in contact with the first interference portion 73*b* while it is moved at the slow pace, no great shock is transmitted to the pivot member 70, and accordingly, the counteraction by the shock is also prevented. As a result, the pivot member 70 does not pivot and remains at the first position, and the guide pin 35 is slowly raised along the first guide rail 73.

As shown in FIG. 2, the upper side of the stacked printing paper smoothly contacts the finger member 50 and then stops, and accordingly, the printing paper is aligned orderly without causing any considerable shock or noise.

Figure 8:
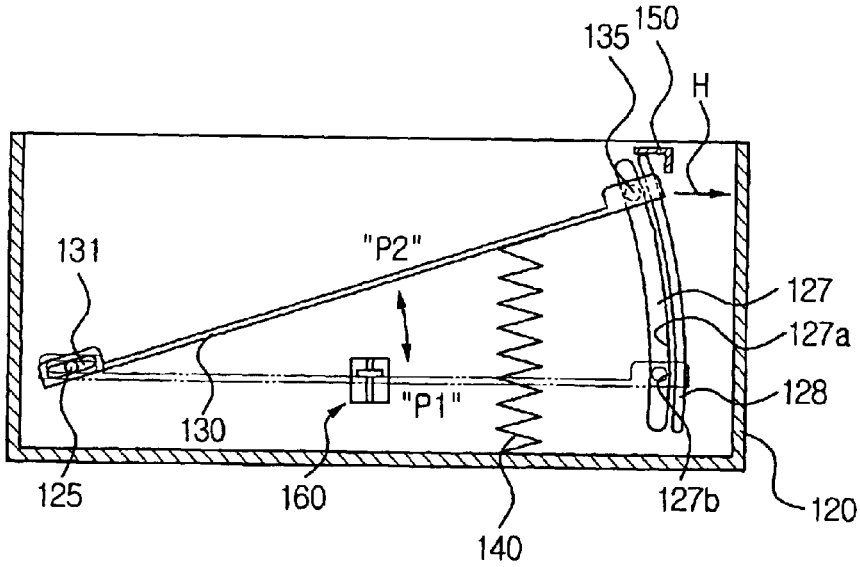
FIG. 8 is a partial sectional view showing another paper cassette of the printing device according to another embodiment of the present invention.

Referring to FIG. 8, the paper cassette of the printing device according to another embodiment of the present invention includes a cassette body 120, a supporting plate 130 movably disposed within the cassette body 120 to be raised and lowered, a spring 140 elastically supporting a lower side of the supporting plate 130 relative to a bottom of the cassette body 120, and a shock absorbing unit limiting a rising height of the supporting plate 130 from a lowest position and also lessening and absorbing a shock.

The cassette body 120 is usually made of plastic. Since the construction of the cassette body 120 is identical to that shown in FIG. 2, a detailed description about the construction of the cassette body 120 will be omitted.

The supporting plate 130 is movably disposed within the cassette body 120 to be raised and lowered and pivoted. The supporting plate 130 supports the printing paper while being elastically supported by the spring 140. The supporting plate 130 has an opening 131 formed in a first end, and a guide pin 135 formed on a second end. The opening 131 receives a hinge pin 125 formed on the cassette body 120 in a manner that the hinge pin 125 rotates and slides within the opening 131. The opening 131 can be formed in the place of the hinge pin 125, and the hinge pin 125 can be formed in the place of the opening 131. The supporting plate 130 can pivot about the opening 131 and slide within the opening 131 by a predetermined distance. The guide pin 135 is moved along a guide rail 127 (described later) to guide an upward/downward pivotal movement of the supporting plate 130.

The supporting plate 130 is secured at the lowest position by a proper locking unit 160. Since the locking unit 160 is described earlier with reference to FIGS. 2 and 3, the description thereof will be omitted here.

The spring 140 elastically supports the other side of the supporting plate 130 to bring the printing paper on the supporting plate 130 into a tight contact with the finger member 150.

The shock absorbing unit includes the opening 131 formed on the first end of the supporting plate 130, the guide pin 135, and the guide rail 127 formed in arc shape in an edge of the cassette body 120.

The guide rail 127 limits a range of the upward/downward pivotal movement of the supporting plate 130 while also guiding the pivotal movement. The guide rail 127 is a guide slot integrally formed in the cassette body 120.

Meanwhile, when the supporting plate 130 is raised by the recovery force of the spring 140, the guide pin 135 is guided to be in tight contact with a side 127*a* of the guide rail 127 that is closer to an outside of the printing cassette. With the guide pin 135 being in tight contact with the surface 127*a*, the frictional force occurs, and accordingly, the rising speed of the supporting plate 130 is reduced.

Also, it is possible that the frictional force providing unit is provided at the side 127*a* to provide an additional frictional force according to the movement of the guide pin 135. More specifically, the frictional force providing unit includes curved portions 127*b* formed on the side 127*a* at a predetermined distance from each other. The curved portions 127*b* are curved inwardly from a surface of the side 127*a* and provide the additional frictional force sufficient to prevent the abrupt sliding of the guide pin 135. It is possible that the curved portions 127*b* are provided in plural at upper and lower ends of the guide rail 127. Accordingly, an initial movement of the supporting plate 130 is checked, and the shock, which occurs when the rising movement of the supporting plate 130 accelerates, can be lessened. In this embodiment, one curved portion 127*b* is formed at the lower end of the guide rail 127 while two curved portions 127*b* are formed at the upper end. Instead of the curved portion 127*b*, however, the elastic substances 77 like the plate spring of FIG. 2 can also be employed on the side 127*a* of the guide rail 127. With either the curved portion 127*b* or the elastic substance 77, the same effect can be obtained.

It is also possible that a secondary slot 128 is formed in the cassette body 120 to lessen the shock between the side 127*a* of the guide rail and the guide pin 135 more effectively by deforming an elastic plate 129 formed between the guide rail 127 and the secondary slot when the guide rail 127 disposed on one side of the elastic plate 129 is in contact with the guide pin 135. The secondary slot 128 has a shape of an arc of a predetermined width and is spaced-apart from the guide rail 127 by a predetermined distance in parallel. A gap corresponding to a thickness of the elastic plate 129) and formed between the guide rail 127 and the secondary slot 128 is elastically deformed when an external force, i.e., the contact force of the guide pin 135, is exerted on the guide rail 127. The shock occurring as a result of the contact force of the guide pin 135 is absorbed when the elastic plate 129 is deformed or bent toward the secondary slot 128. Since the guide rail 127 and the secondary slot 128 are formed in the plastic cassette body 120 that is elastic, the shock is absorbed considerably.

The operation and effect of the paper cassette of the printing device constructed as above according to another embodiment of the present invention will be described below.

First, the user of the printing device lowers and secures the supporting plate 130 to a position "P1" of FIG. 1. Next, the user stacks a predetermined amount of the printing paper on the supporting plate 130. Then, as the user releases the locking unit 160, the supporting plate 130 is raised by the recovery force of the spring 140. In such a situation, the recovery force of the spring 140 varies in a direction H, and as a result, the guide pin 135 keeps being in contact with the side 127*a* of the guide rail 127 during movement along the guide rail 127. This is possible because of the opening 131 formed in the first end of the supporting plate 130 to enable the supporting plate 130 not only to slide but also to pivot.

Figure 9:
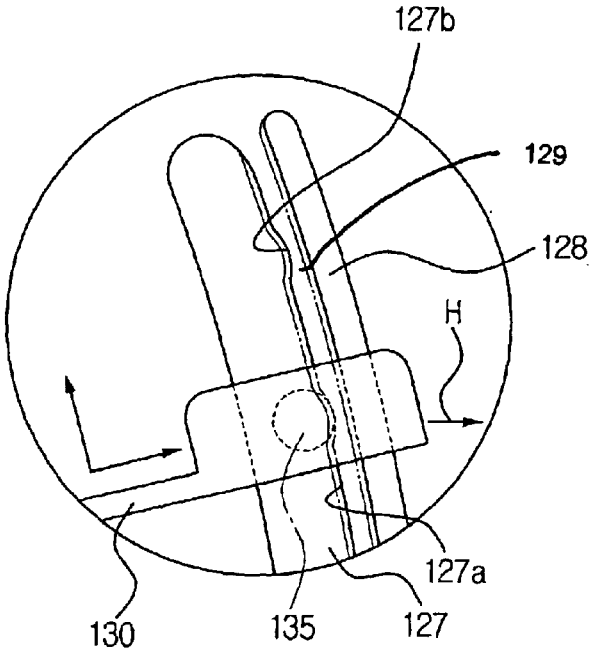
FIG. 9 is an enlarged view explaining an operation of the paper cassette of FIG. 8.

In a process that the guide pin 135 is raised in contact with the side 127*a* of the guide rail 127, the guide pin 135 comes into contact with the curved portions 127*b* as shown in FIG. 9, and accordingly, the moving speed of the guide pin 135 decreases. Further, when the guide pin 135 contacts the curved portions 127*b*, the gap (thickness) of the elastic plate 129 made of plastic and disposed between the secondary slot 128 and the guide rail 127 deforms to lessen and absorb the shock. Since the guide pin 135 passes the curved portion 127*b* and thus loses the moving speed, the finger member 150 does not receive the excessive shock when the supporting plate 130 is raised further to the position 'P2'. As a result, the separation of the printing paper due to a collision of the supporting plate 130 against the finger member 150 and the noise generated due to the shock can be prevented.

Meanwhile, when more than 300 sheets of printing paper are stacked on the supporting plate 130, the weight of the stacked printing paper compensates for the recovery force of the spring 140, and the supporting plate 130 rises slowly. Accordingly, the noise or error from the collision of the supporting plate 130 with the finger member 150 can be prevented.

As described above, in the paper cassette of the printing device according to the present invention, when the supporting plate stacked with the printing paper springs up, the shock created due to the collision of the supporting plate against the finger member can be lessened and absorbed. As a result, the unwanted separation of the printing paper is prevented while the noise from the collision is reduced.

Although a few preferred embodiments of the present invention have been shown and described, it would be appreciated by those skilled in the art that changes may be made in this embodiment without departing from the principles and spirit of the invention, the scope of which us defined in the claims and their equivalents.

What is claimed is:

1. A paper cassette in a printing device having a body, comprising:

a cassette body connected to the body of the printing device;

a supporting plate having a first end pivotally disposed in the cassette body to support printing paper and to move in a first state and a second state;

a spring elastically supporting a side of the supporting plate relative to a bottom of the cassette body;

a finger member disposed on the cassette body to limit a rising height of the supporting plate from the bottom of the cassette body and controlling the printing paper to be separated sheet by sheet; and a shock absorbing unit attached to the second and guiding a rising and lowering movement of the supporting plate between the first state and the second state by guiding a second end of the supporting plate, lessening a shock exerted on the finger member when the supporting plate stacked with the printing paper rises from a lowered state, and reducing a rising speed of the supporting plate that is raised by the spring.

2. The paper cassette of claim 1, further comprising a locking unit securing the supporting plate in the lowered state when the supporting plate is lowered to be in close contact with the bottom of the cassette body, wherein the locking unit is unlocked when the supporting plate is inserted into the body of the printing device.

3. A paper cassette in a printing device having a body, comprising:

a cassette body connected to the body of the printing device;

a supporting plate having a first end pivotally disposed in the cassette body to support printing paper and to move in a first state and a second state;

a spring elastically supporting a side of the supporting plate relative to a bottom of the cassette body;

a finger member disposed on the cassette body to limit a rising height of the supporting plate from the bottom of the cassette body and controlling the printing paper to be separated sheet by sheet; and a shock absorbing unit guiding a rising and lowering movement of the supporting plate between the first state and the second state by guiding a second end of supporting platr distal to the first end, lessening a shock exerted on the finger member when the supporting plate stacked with the printing paper rises from a lowered state, and reducing a rising speed of the supporting plate that is raised by the spring, wherein the shock absorbing unit comprises:

a guide pin formed on a second end of the supporting plate; and a pivot member pivotally disposed on the cassette body, the pivot member having a first guide rail that guides the guide pin when the supporting plate moves at a first speed and a second guide rail that guides the guide pin when the supporting plate moves at a second speed while providing the guide pin with a frictional force so as to reduce a pivotal force of the supporting plate.

4. The paper cassette of claim 3, wherein the pivot member reciprocates between a first position and a second position, the first guide rail guiding the guide pin when the pivot member is in the first position and the second guide rail guiding the guide pin when the pivot member is in the second position, and with the supporting plate being at the first state, the pivot member being moved to the first position.

5. The paper cassette of claim 4, wherein the pivot member comprises a first interference portion and a first entry portion, and, during the rising movement of the supporting plate, the guide pin comes into contact with the first interference portion of the first guide rail, and the pivot member staying in the first position or being forced to pivot to the second position according to a contact force between the first interference portion and the guide pin.

6. The paper cassette of claim 5, wherein the contact force of the guide pin relative to the first interference portion is determined according to the first and second speeds of the supporting plate that is determined according to an amount of the printing paper stacked on the supporting plate.

7. The paper cassette of claim 5, wherein the pivot member comprises a second interference portion, a second entry portion, and a guide side formed between the first entry portion and the second entry portion, and when the pivot member is pivoted to the second position by the contact force generated between the first interference portion and the guide pin, the guide pin is guided from the first entry portion of the first guide rail by the guide side to the second entry portion of the second guide rail.

8. The paper cassette of claim 3, wherein the pivot member comprises a pair of elastic substances disposed on an inner side of the second guide rail to provide the frictional force during the movement of the guide pin along the second guide rail.

9. The paper cassette of claim 8, wherein the pair of elastic substances are extended from the second entry portion of the second guide rail by a distance corresponding to two thirds of a length of the second guide rail.

10. The paper cassette of claim 3, wherein the second guide rail comprises an entry portion and an interference portion protruding from the entry portion to have a predetermined shape to interfere with the guide pin moving along the second guide rail, and with the supporting plate being lowered and the guide pin moving into the second guide rail, the pivot member is forcedly pivoted from the second position to the first position by a contact force between the interference portion and the guide pin.

11. The paper cassette of claim 3, further comprising a guide unit limiting a range of a pivotal movement of the pivot member and guiding the pivotal movement of the pivot member.

12. The paper cassette of claim 11, wherein the guide unit comprises:

a third guide rail formed in the pivot member; and a securing pin disposed in the cassette body to guide the pivot member to move along the third guide rail.

13. A paper cassette in a printing device having a body, comprising:

a cassette body connected to the body of the printing device;

a supporting plate movably disposed within the cassette body to move in a first state and in a second state to support printing paper and a second end;

a spring elastically supporting an end of the supporting plate relative to the bottom of the cassette body; and a shock absorbing unit attached to the second end guiding the supporting plate to move between the first and second states by guiding an end of the supporting plate, lessening a shock generated when the supporting plate moves between the first and second states, reducing a rising speed of the supporting plate when the supporting plate stacked with the printing paper is moved by the spring, and limiting a rising height of the supporting plate.

14. A paper cassette in a printing device having a body, comprising:

a cassette body connected to the body of the printing device;

a supporting plate movably disposed within the cassette body to move in a first state and in a second state to support printing paper;

a spring elastically supporting one end of the supporting plate relative to the bottom of the cassette body; and a shock absorbing unit guiding the supporting plate to move between the first and second states, lessening a shock generated when the supporting plate moves between the first and second states, reducing a rising speed of the supporting plate when the supporting plate stacked with the printing paper is moved by the spring, and limiting a rising height of the supporting plate, wherein the shock absorbing unit comprises:

a portion defining an opening that is formed on one of the cassette body and the supporting plate to support a first end of the supporting plate to pivot relative to the cassette body and slide by a predetermined distance;

a guide pin formed at a second end of the supporting plate; and a guide rail in a shape of an arc and formed in the cassette body to guide the guide pin during a movement of the supporting plate;

wherein the guide pin is guided to be in contact with one side of the guide rail by a pressing force of the spring, to reduce a rising force of the supporting plate.

15. The paper cassette of claim 14, wherein the shock absorbing unit comprises a frictional force providing unit formed on the one side of the guide rail which is in contact with the guide pin to selectively provide a frictional force according to a moved position of the guide pin.

16. The paper cassette of claim 15, wherein the frictional force providing unit comprises a curved portion curved inwardly from a surface of the one side of the guide rail to provide the guide pin with the frictional force.

17. The paper cassette of claim 14, wherein the guide rail is a guide slot integrally formed in an inner side of the cassette body.

18. The paper cassette of claim 17, wherein the shock absorbing unit comprises a secondary slot formed in the cassette body in parallel with the guide rail to provide the frictional force by being deformed when the guide pin contacts with the one side of the guide slot.

19. A paper cassette in a printing device, comprising:

a cassette body;

a supporting plate moving in a first state and in a second state within the cassette body;

an elastic member elastically supporting the supporting plate to move at a first speed and a second speed between the first state and the second state, respectively; and a shock absorbing unit having a first guide rail guiding the supporting plate when the supporting plate moves at the first speed, and a second guide rail guiding the supporting plate when the support plate moves at the second speed.

20. The paper cassette of claim 19, wherein the shock absorbing unit is rotatably disposed on the cassette body and moves to a first position and a second position in response to one of the first speed and the second speed of the supporting plate to guide the supporting plate with one of the first and second guide rails.

21. The paper cassette of claim 19, wherein the supporting plate moves at the first speed and the second speed in response to an amount of printing paper stacked on the supporting plate, and the shock absorbing unit guides the supporting plate with one of the first and second guide rails in response to one of the first speed and the second speed.

22. The paper cassette of claim 19, wherein the second guide rail reduces the second speed of the support plate to a third speed less than the second speed when the supporting plate moves into the second guide rail at the second speed.

23. The paper cassette of claim 19, wherein the shock absorbing unit comprises a first portion having the first weight and a second portion having a second weight less than the first weight, and the absorbing unit moves to the first position in response to the first weight to allow the first guide rail to guide the supporting plate moving at the first speed and moves to the second position in response to a movement of the supporting plate moving at the second speed greater than the first speed to allow the second guide rail to guide the supporting plate.

24. The paper cassette of claim 19, wherein the shock absorbing unit moves to a first position in response to a self weight to guide the supporting plate with the first guide rail and moves to a second position in response to a movement of the supporting plate to guide the supporting plate with the second guide plate.

25. The paper cassette of claim 19, wherein the second guide rail comprises an element to reduce the second speed of the supporting plate when the supporting plate moves along the second guide rail at the second speed.

26. The paper cassette of claim 19, wherein the shock absorbing unit comprises:

a pivot member rotating about a pivot and having the first guide rail and the second guide rail; and a guide pin formed on the supporting plate to move along one of the first guide rail and the second guide rail when the supporting plate moves at the first speed and the second speed, respectively.

27. The paper cassette of claim 26, wherein the pivot member comprises a guide surface formed between the first guide rail and the second guide rail to guide the guide pin between the first guide rail and the second guide rail.

28. The paper cassette of claim 26, wherein the first guide rail and the second guide rail form a V shape with respect to the pivot of the pivot member.

29. The paper cassette of claim 26, wherein the first guide rail comprises a first entry portion and a first interference portion guiding the guide pin into the first entry portion when the guide pin moves at the first speed slower than the second speed.

30. The paper cassette of claim 29, wherein the first interference portion guides the guide pin into the second guide rail when the guide pin moves in the second speed to contact the first interference portion.

31. The paper cassette of claim 29, wherein the second guide rail comprises a second entry portion and a second interference portion guiding the guide pin from the first guide rail to the second entry portion.

32. The paper cassette of claim 29, wherein the second interference portion guides the guide pin to move to the first guide rail when the guide pin moves out from the second entry portion of the second guide rail.

33. The paper cassette of claim 26, wherein the first guide rail and the second guide rail form in a radial direction about the pivot.

34. The paper cassette of claim 26, wherein the supporting plate comprises a hinge about which the guide pin rotates in the first state and the second state, and the elastic member is disposed between the pivot and the hinge.

35. The paper cassette of claim 34, wherein the first guide rail and the second guide rail are correspondingly disposed in a tangential direction of a circle formed about the hinge when the guide pin is disposed in a respective one of the first guide rail and the second guide rail.

36. The paper cassette of claim 34, wherein the pivot is disposed between the first guide rail and the second guide rail.

37. The paper cassette of claim 26, wherein the pivot member comprises a third guide rail, and a securing pin is disposed in the third guide rail to limit a movement range of the pivot member.

38. The paper cassette of claim 37, wherein the third guide rail is disposed on a circle formed around the pivot.

39. The paper cassette of claim 37, wherein the first guide rail and the second guide rail are disposed between the third guide rail and the pivot.

40. The paper cassette of claim 37, wherein the first guide rail and second guide rail extend from the pivot toward respective end portions of the third guide rail.

41. The paper cassette of claim 26, wherein the shock absorbing unit comprises:

a portion defining a longitudinal opening formed on a first end of the supporting plate in a direction parallel to a major surface of the supporting plate;

a hinge pin formed on the cassette body to slidably and rotatably disposed in the longitudinal opening; and a guide pin formed on a second end of the supporting plate to move along one of the first guide rail and the second guide rail.

42. The paper cassette of claim 41, wherein the first guide rail is disposed on a circle formed around the hinge pin.

43. The paper cassette of claim 42, wherein the second guide rail is formed in a radial direction of the hinge pin.

44. The paper cassette of claim 41, wherein the second guide rail is disposed in the first guide rail and curved inwardly from a surface of the first guide rail.

45. The paper cassette of claim 41, wherein the second pin moves along the first guide rail when the guide pin moves at the first speed together with the supporting plate and moves along the second guide rail when the guide pin moves at the second speed greater than the first speed.

46. The paper cassette of claim 41, wherein the hinge pin moves and rotates along the longitudinal opening when the guide pin moves along the first guide rail and the second guide rail.

47. The paper cassette of claim 41, wherein the second guide rail comprises curved portions formed on a surface of the first guide rail and spaced-apart from each other along the surface of the first guide rail at a predetermined interval.

48. The paper cassette of claim 41, wherein the shock absorbing unit comprises:

a secondary slot formed around the first guide rail.

49. The paper cassette of claim 48, wherein the secondary slot is disposed adjacent to the first guide rail opposite to the hinge pin.

50. The paper cassette of claim 48, wherein the shock absorbing unit comprises a elastic plate formed between the first guide rail and the secondary slot to absorb a shock generated when the guide pin moves in the second speed greater than the first speed.

51. The paper cassette of claim 50, wherein a thickness of the elastic plate is less than a distance between both sides of the first guide rail in a radial direction of the hinge pin.

* * * * *

UNITED STATES PATENT AND TRADEMARK OFFICE

CERTIFICATE OF CORRECTION

PATENT NO. : 6,773,182 B2
DATED : August 10, 2004
INVENTOR(S) : Chun-seung Yang

It is certified that error appears in the above-identified patent and that said Letters Patent is hereby corrected as shown below:

Column 10,
Line 48, between “state” and “;” insert -- and a second end --;
Line 55, change “and” to -- end --;

Signed and Sealed this

Fourth Day of January, 2005

JON W. DUDAS
*Director of the United States Patent and Trademark Office*